United States Patent [19]

Ruud

[11] 3,968,922

[45] July 13, 1976

[54] FRUSTO-PYRAMIDAL BOX WITH HINGED LID

[76] Inventor: Gunnar Ruud, Lundgardsvel 63, 1700 Sarpsborg, Norway

[22] Filed: Mar. 4, 1975

[21] Appl. No.: 555,251

[30] Foreign Application Priority Data

Mar. 6, 1974 Norway ..... 740778/74

[52] U.S. Cl. ..... 229/33; 229/31 R; 229/44 R

[51] Int. Cl.[2] ..... B65D 5/26; B65D 5/66

[58] Field of Search ..... 229/31 R, 33, 34 R, 229/44 R

[56] References Cited

UNITED STATES PATENTS

| | | | |
|---|---|---|---|
| 2,852,177 | 9/1958 | Frasch | 229/33 |
| 3,084,843 | 4/1963 | Urban | 229/30 |
| 3,825,169 | 7/1974 | Meyers | 229/34 R |
| 3,829,004 | 8/1974 | Graser | 229/33 |

*Primary Examiner*—William Price
*Assistant Examiner*—Douglas B. Farrow
*Attorney, Agent, or Firm*—Young & Thompson

[57] ABSTRACT

A box has a frusto-pyramidal base with a frusto-pyramidal lid hinged thereto. The free edge of the lid has a support tab of a width sufficient to fit within the closed box and rest with its free edge on the bottom of the box thereby to support the lid. A locking tab on the adjacent free edge of the base engages in a slot in the lid between the support tab and the adjacent side-wall of the lid.

1 Claim, 3 Drawing Figures

FIG. 1
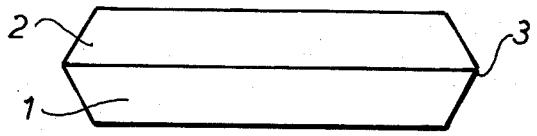
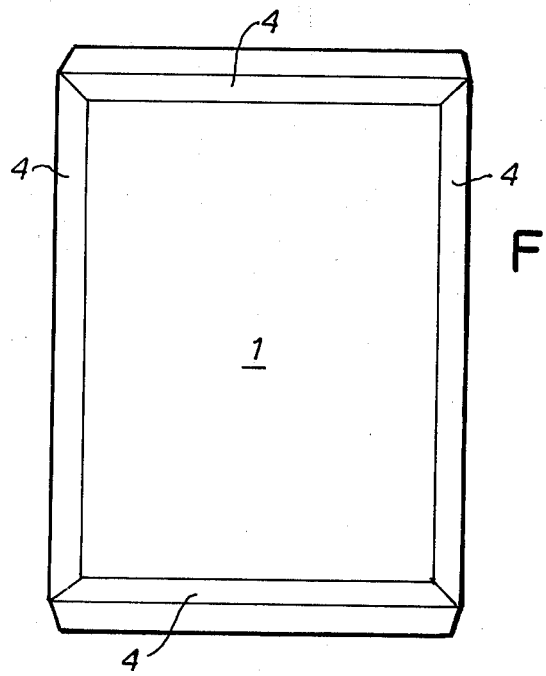
FIG. 2
FIG. 3
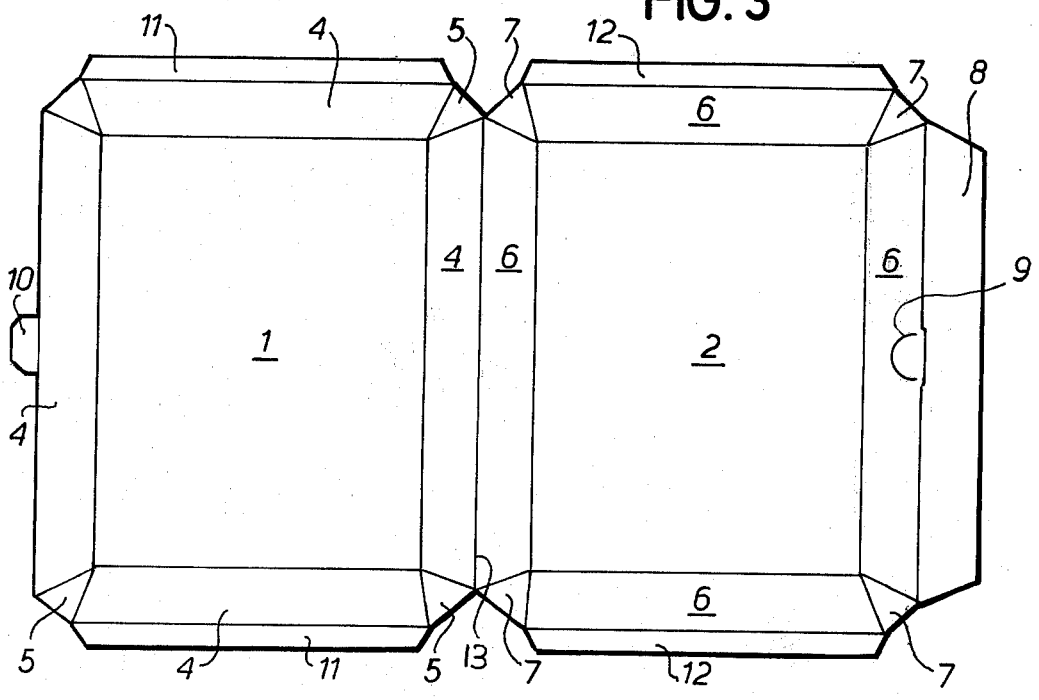

FRUSTO-PYRAMIDAL BOX WITH HINGED LID

The invention relates to a packaging means in the form of a box having a lid of the type which is folded from a flat blank of cardboard, plastic material or other sheet material.

There have been many embodiments of such boxes in recent times and, in order to save space, they are produced and packed in flat state in stacks for transport to the consumer who must then construct the boxes when these are to be sold with goods. Although box constructions have been produced which require only a simple manipulation for construction from flat state to finished state for filling with goods, the previously known embodiment examples require suitable equipment for construction or must be manually constructed, and this causes extra expense with respect to the large number of boxes used in the various fields. There has long been a need for delivery of box-shaped packaging to the consumer in constructed state ready for filling, and this is also expedient on the production side since construction and gluing of a box is a normal and technically correct step in the production process necessary for practical production of packaging. With ready constructed boxes, however, problems arise in transport from the producer to the consumer since the finished empty boxes take up greater space, and the purpose of the present invention is to provide a box embodiment which can be produced as a finished article by the producer and delivered, ready for use, without further manipulation by the consumer, and, at the same time, the transport costs are reduced to approximately what they would be if the boxes were delivered as semi-finished products, i.e. as flat boxes or flattened boxes.

In accordance with the invention, this is achieved in that the boxes which are glued to finished state by the producer have a shape such that, in finished state they can be closely stacked and fill the load volume equally as well as flat blanks.

The boxes are provided with a lid which, as required can be flat or frusto-pyramidal, and are stackable, having the same height as the box or with differing dimensions. The lid may be provided with a tab at its free end which supports the lid on the bottom of the box so that the box, with goods therein, can be stacked without damage. Moreover, at the free edges thereof both box and lid can be provided with outwardly projecting ears or flanges which support the lid on the box and can form sealing surfaces when it is necessary to close the packaging.

The invention is characterized by the features disclosed in the claims.

An example of the invention is further explained in the following with reference to the drawing where:

FIG. 1 is a box in accordance with the invention, viewed from the side,

FIG. 2 is the box of FIG. 1 viewed from above with the lid removed and,

FIG. 3 is a blank for producing the box according to FIGS. 1 and 2.

As illustrated in FIG. 1, the packaging comprises a box 1 having a quadrangular base and a lid 2 which is integral with the box 1 by means of a hinge 3. In FIG. 2 the box is seen from above with inclined sidewalls 4 which gives the box a frusto-pyramidal shape so that it can be stacked. In the example shown, the lid 2 has the same shape and dimension as the box 1, which does not prevent stacking, with the lid in open condition. The blank shown in FIG. 3 comprises the bottom of the box 1 with sidewalls 4 and folding tabs 5 which are folded inwardly so that the box is constructed at the location of stacking and glued so that the packaging is finished at the place of production.

The lid 2 has the same shape as the box 1 with sidewalls 6 and folding tabs 7 which are stamped so that the lid has a frusto-pyramidal shape when it is constructed at the place of production by folding and gluing of the tabs 7. The lid and box are hinged together as a blank along the line 13.

The lid 2 is also provided with a support tab 8 which, when the lid is closely correctly on the box 1, rests against the bottom of the box and supports the free edge of the lid. Further, the lid and box are provided with slots 9, in the sidewall 6 and on the fold line between sidewall 6 and tab 8. Element 10 on the corresponding sidewall 4 serves as a locking tab when inserted through the slots 9 upon closing of the container. 10 for locking of the lid into closed position.

To facilitate stacking, it is expedient to provide the box and lid with outwardly directed flanges 11, 12 which form a support for the lid on the box, so that the boxes can be stacked in great numbers without damage to the lowest box in the stack due to loading.

Further, the flanges 11, 12 are adapted for sealing of packaging, for example, heat sealing when the material is coated with polyethylene.

Having described my invention, I claim:

1. A box having a frusto-pyramidal base and a frusto-pyramidal lid hinged thereto, the box sidewall opposite the hinge having a locking tab thereon, the lid having a support tab foldably connected to the lid sidewall which is opposite said hinge, said support tab having a width such that when the box is closed and the support tab is disposed inside the box, the free edge of the support tab contacts the bottom of the box to support the lid, there being a slot through said lid adjacent said support tab to receive said locking tab.

* * * * *